US006016733A

United States Patent [19]

Lin

[11] Patent Number: 6,016,733

[45] Date of Patent: Jan. 25, 2000

[54] CARD CORNER CUTTER

[76] Inventor: Chien-Fu Lin, No.22 Alley 214, Fu Sun Lane, Taichung City, Taiwan

[21] Appl. No.: 09/006,907

[22] Filed: Jan. 14, 1998

Related U.S. Application Data

[63] Continuation-in-part of application No. 08/807,833, Feb. 27, 1997, abandoned.

[51] Int. Cl.[7] ..... B26D 5/08

[52] U.S. Cl. ..... 83/589; 83/467.1; 83/564; 83/694; 83/605

[58] Field of Search ..... 83/564, 583, 585, 83/588, 601, 605, 694, 467.1, 589; 30/229, 178

[56] References Cited

U.S. PATENT DOCUMENTS

| | | | |
|---|---|---|---|
| D. 319,172 | 8/1991 | Vaccaro | D8/98 |
| 629,824 | 8/1899 | Southworth | 83/588 X |
| 1,365,070 | 1/1921 | Zealand | 83/588 X |
| 1,447,247 | 3/1923 | Milsdorf | 83/694 X |
| 1,675,161 | 6/1928 | Chobar | 83/588 X |
| 2,082,867 | 6/1937 | Andersen | 83/694 X |
| 2,108,178 | 2/1938 | Rosenberg | 83/588 X |
| 2,163,868 | 6/1939 | Christie | 83/588 X |
| 2,936,665 | 5/1960 | Naffin | 83/694 X |
| 3,516,317 | 6/1970 | Sundquist et al. | 83/694 X |
| 3,656,387 | 4/1972 | Wark | 83/588 X |
| 4,941,381 | 7/1990 | Garner | 83/589 X |
| 5,611,254 | 3/1997 | Rall | 83/467.1 X |

FOREIGN PATENT DOCUMENTS

| | | | |
|---|---|---|---|
| 2032518 | 1/1972 | Germany | 83/588 |
| 3613511 | 10/1987 | Germany | 83/467.1 X |

*Primary Examiner*—Rinaldi I. Rada
*Assistant Examiner*—Boyer Ashley
*Attorney, Agent, or Firm*—Charles E. Baxley

[57] ABSTRACT

A card corners cutter includes a body having a top surface with two sides and a bottom, the two sides each having a tube attached thereto in which a spring is received. Two guides extend upwardly from two sides the top surface. A passage and a slot are respectively and transversely defined through the body. A working surface is defined in the top surface and located lower than the top surface so as to fixedly position a first knife member on the working surface. A recess is defined in the bottom of the body and communicates with the passage and the slot. A first pin and a second pin are respectively received in the passage and the slot. A torsion spring is mounted to the first pin. A handle is pivotally connected to two ends of the second pin and is limited by the two guides. A second knife member is disposed to an underside of the handle and each of the first knife member and the second knife member has a curved cutting edge so as to shape a card inserted between the first knife member and the second knife member by pushing the handle downwardly.

5 Claims, 4 Drawing Sheets

CARD CORNER CUTTER

This is a Continuation-in-part application of U.S. patent application Ser. No. 08/807,833 to Lin, filed on Feb. 27, 1997, now abandoned.

BACKGROUND OF THE INVENTION

1. Field of the Invention

The present invention relates to a cutter which shapes corners of cards to be rounded corners and, more particularly, to a cutter composing of a body with a first knife member fixedly disposed thereto and a second knife member pivotally disposed to a handle which is pivotally connected to the body so as to shape a corner of a card inserted between the first and the second knife member.

2. Brief Description of the Prior Art

Business cards generally are made of paper and have rectangular configuration with four corners. Some people prefer four corners of their cards to be shaped as rounded corners in order to grasp attentions of receivers when they first receive the cards with rounded corners. However, business cards have a standard shape which is rectangular so that if a owner wants his/her cards to have rounded corners, he/she has to pay additional money to shape the corners. Therefore, in order to save this disbursement, the owner may try to shape the corners of the cards by himself/herself. Unfortunately, if using a pair of scissors to shape the corners will usually fails because the corners formed by the scissors usually have an asymmetrical configuration.

Some cutting devices for shaping corners of cards are developed which known to Applicant are U.S. Pat. No. 3,516,317, "corner Rounding Punch And Die Assembly" to N. E. Sundquist et al, U.S. Pat. No. 4,401,002, "Soffit Cutting Mechanism" to Victor H. Worsham, U.S. Pat. No. 5,555,785, "Paper Slitting Device With Integral Spring Biasing Means" to Scalise et al, U.S. Pat. No. 4,941,381, "Portable Business Card Slit Cutter" to Sandra Brown Garner, U.S. Pat. No. 3,656,387, "Corner Cutter Machine" to Wark, and U.S. Design Pat. No. D 319,172 "Machine For Cutting The Corner Off Business Cards" to Daniel Vaccaro.

The present invention intends to provide a card corners cutter to mitigate and/or obviate the above-mentioned problems.

SUMMARY OF THE INVENTION

In one aspect of the present invention, there is provided a card corners cutter comprising a body having a top surface with two sides extending from the top surface, and a bottom, wherein a working surface is defined in the top surface and located lower than the top surface. The two sides each have a lug respectively extending laterally therefrom and each of the lugs has a tube extending upwardly therefrom so as to receive a spring therein. Two guides are respectively connected to the two sides and extend upwardly from the top surface. A passage and a slot are respectively and transversely defined through the body. A recess is defined in the bottom of the body and communicates with the passage and the slot.

A first pin is received in the passage and a second pin is movably received in the slot with a torsion spring mounted to the first pin. One of two legs of the torsion spring contacts against the second pin and the other leg of the torsion spring contacts against an inner side defining the recess.

A handle has two ends thereof respectively and pivotally connected to two ends of the second pin and is limited by the two guides. The two springs contact against an underside of the handle.

A first knife member is fixedly disposed to the working surface and has a first curved cutting edge defined in an outer periphery thereof. A second knife member is disposed to the underside of the handle and has a second curved cutting edge defined in an inner periphery thereof. The second curved cutting edge has the same curvature as that of the first cutting edge of the first knife member so as to be adapted to shape a card inserted between the first knife member and the second knife member by pushing the handle toward the first knife member.

It is an object of the present invention to provide a card corners cutter which scissors corners of a card easily and evenly.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
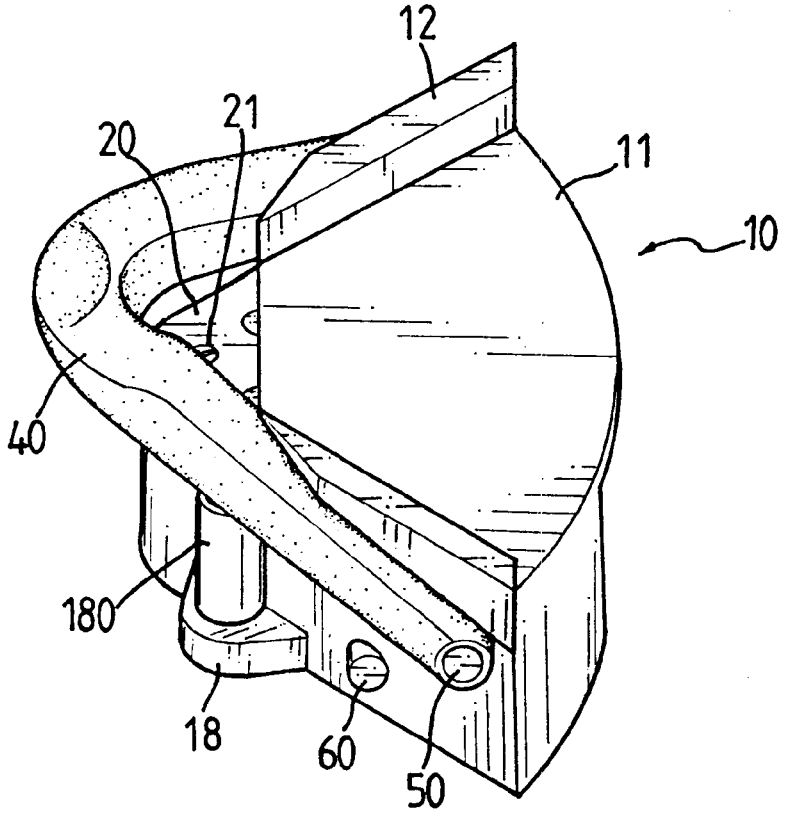
FIG. 1 is a perspective view of a card corners cutter in accordance with the present invention.
Figure 2:
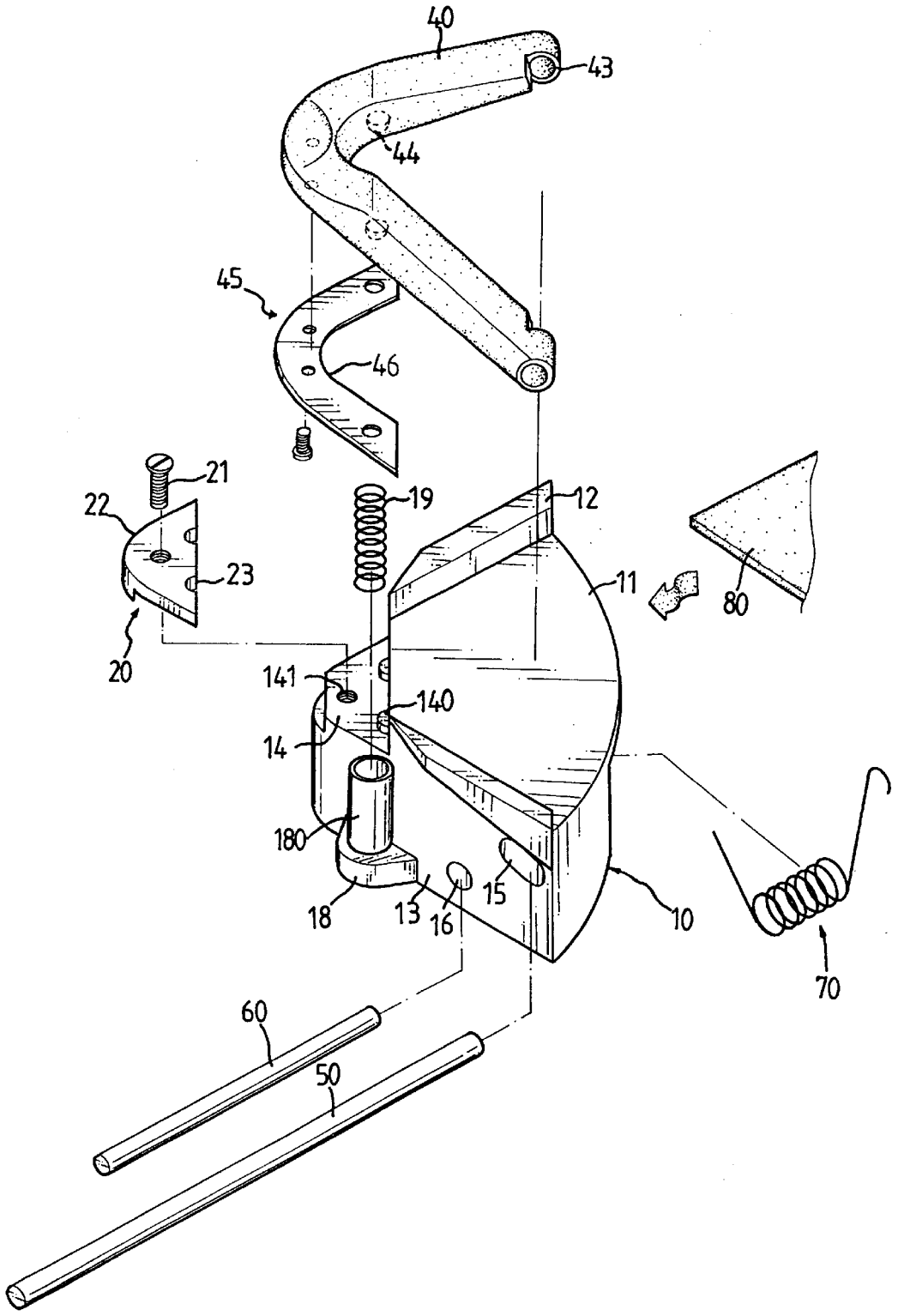
FIG. 2 is an exploded view of the card corners cutter in accordance with the present invention.

Referring to the drawings and initially to FIGS. 1 and 2, a card corners cutter in accordance with the present invention generally includes a body 10 having a top surface 11 with two sides 13 extending from the top surface 11 and a bottom into which a recess 17 is defined. The two sides each have a lug 18 extending laterally therefrom and each of the lugs 18 has a tube 180 extending upwardly therefrom so as to receive a spring 19 therein. Two guides 12 are respectively connected to the two sides 13 and extend upwardly from the top surface 11. A passage 16 and a slot 15 are respectively and transversely defined through the body 10. A working surface 14 extends from the body 10 and located lower than the top surface 11 of the body 10. The working surface 14 has a threaded hole 141 defined therein and two bosses 140 extending from the working surface 14. The recess 17 defined in the bottom of the body 10 communicates with the passage 16 and the slot 15. A first pin 60 is received in the passage 16 and a second pin 50 is movably received in the slot 15. A torsion spring 70 is mounted to the first pin 60, one of two legs of the torsion spring 70 contacting against the second pin 50 and the other leg of the torsion spring 70 contacting against an inner side defining the recess 17.

Figure 4:
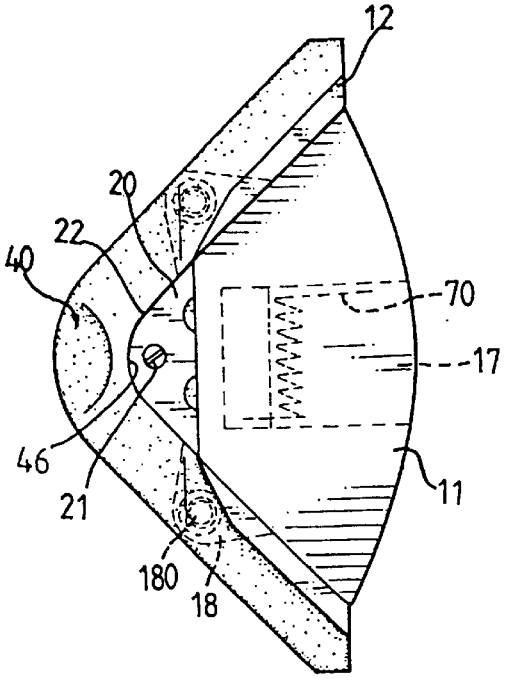
FIG. 4 is a top plan view to show the structural relationship between the first knife member and the second knife member of the card corners cutter.

A transverse V-shaped handle 40 has a ring member 43 connected to each one of two ends thereof so that the second pin 50 is connected between the two ring members. The handle 40 is limited at its top surface by the two guides 12 connected to the two sides 13 of the body 10 (see FIG. 4) and the two springs 19 contacting against an underside of the handle 40. The handle 40 has two studs 44 extending downwardly from the underside thereof so as to be respectively received in the springs 19.

A first knife member 20 is fixedly disposed to the working surface 14 by extending a bolt 21 through the first knife member 20 and threadedly engaged with the threaded hole 141. The first knife member 20 has a first curved cutting edge 22 defined in an outer periphery thereof. The first knife member 20 further has two recesses 23 defined in an underside thereof so as to receive the two bosses 140 to position the first knife member 20.

A second knife member 45 is disposed to the underside of the handle 40 and has a second curved cutting edge 46 defined in an inner periphery thereof. The second curved cutting edge 46 has the same curvature as that of the first cutting edge 22 of the first knife member 20 so as to be adapted to shape a card 80 inserted between the first knife member 20 and the second knife member 45 by pushing the handle 40 toward the first knife member 20.

Figure 3:
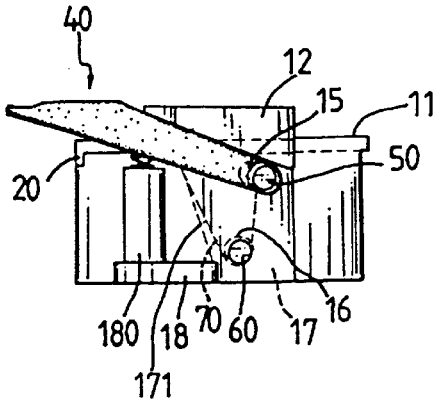
FIG. 3 is a side elevational view of the card corners cutter wherein the reinforced spring is shown in phantom lines.

It is to be noted that, referring to FIG. 3, the second knife member 45 disposed to the handle 40 is located inclinedly to the second knife member 20 on the working surface 14.

Figure 6:
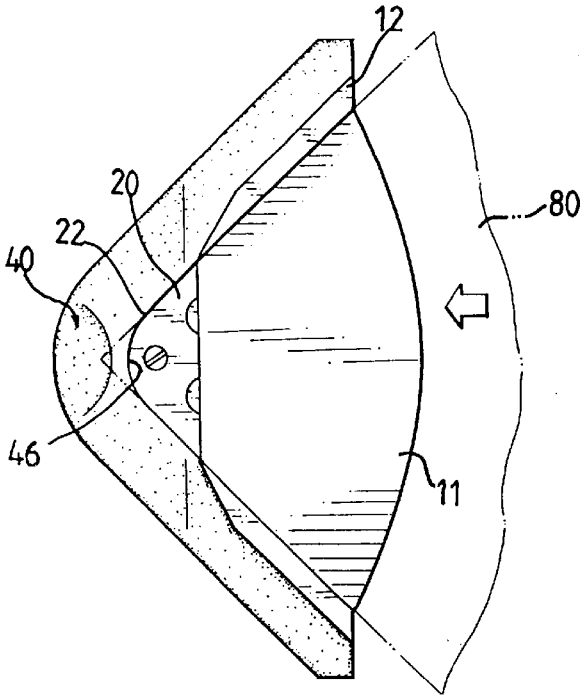
FIG. 6 is a top plan view of the card corners cutter shown in FIG. 5.
Figure 5:
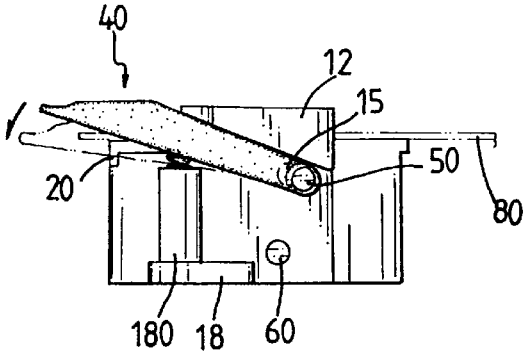
FIG. 5 is a side elevational view of the card corners cutter wherein the second knife member is pushed downwardly toward the first knife member to scissor a corner of a card out.

Referring to FIGS. 5 and 6, the card 80 is inserted one of its four corners between the first knife member 20 and the second knife member 45 with two sides of the card 80 guided by the two guides 12. The handle 40 is then pushed downwardly toward the first knife member 20 such that the second cutting edge 46 is snugly engaged with the first cutting edge 22 to shape the corner of the card 80 to be rounded. The first pin 50 is slightly moved within the slots 15 when the handle 40 is pushed to let the second cutting edge 46 move along the first cutting edge 22 to precisely cut the card 80. That is to say, there is only a very small tolerance defined between the first cutting edge 22 and the second cutting edge 46 when the two cutting edges 22, 46 are cutting the card 80. Therefore, the rounded portion of the card 80 is defined clearly and the card 80 is not clamped between the first cutting edge 22 and the second cutting edge 46.

Although the invention has been explained in relation to its preferred embodiment, it is to be understood that many other possible modifications and variations can be made without departing from the spirit and scope of the invention as hereinafter claimed.

What is claimed is:

1. A card corners cutter comprising:

a body having a surface and a bottom, two sides extending from said surface, said two sides each having a lug extending laterally therefrom and each of said lugs having a tube extending therefrom, each tube having a spring received therein, two guides respectively connected to said two sides and extending from said surface, a passage and a slot respectively defined through said body, a working surface extending from said body and located lower than said surface of said body, a recess defined in said bottom of said body and communicating with said passage and said slot;

a first pin received in said passage and a second pin movably received in said slot, a torsion spring mounted to said first pin, one of two legs of said torsion spring contacting against said second pin and the other leg of said torsion spring contacting against an inner side defining said recess;

a handle having two ends which are respectively and pivotally connected to two ends of said second pin, said handle being limited by said two guides connected to said two sides of said body and said two springs contacting against an underside of said handle;

a first knife member fixedly connected to said working surface and a first curved cutting edge defined in an outer periphery of said first knife member, and a second knife member connected to said underside of said handle and a second curved cutting edge defined in an inner periphery of said second knife member, said second curved cutting edge having the same curvature as that of said first cutting edge of said first knife member so as to be adapted to shape a card inserted between said first knife member and said second knife member by pushing said handle toward said first knife member.

2. The cutter as claimed in claim 1 wherein each of said two ends of said handle has a ring member and said second pin connected between said two ring members.

3. The cutter as claimed in claim 1 wherein said handle has two studs extending from said underside thereof so as to be received in said springs.

4. The cutter as claimed in claim 1 wherein said working surface has two bosses and two recesses are defined in an underside of said first knife member so as to receive said two bosses to position said first knife member.

5. The cutter as claimed in claim 1 wherein said second knife member connected to said handle is located inclinedly to said first knife member on said working surface.

* * * * *